US008490221B1

(12) United States Patent
Conde

(10) Patent No.: US 8,490,221 B1
(45) Date of Patent: Jul. 23, 2013

(54) TOILET FLUSH AND ODOR CONTROL SYSTEM

(76) Inventor: Kandas Conde, Staten Island, NY (US)

( * ) Notice: Subject to any disclaimer, the term of this patent is extended or adjusted under 35 U.S.C. 154(b) by 0 days.

(21) Appl. No.: 13/406,812

(22) Filed: Feb. 28, 2012

Related U.S. Application Data

(63) Continuation-in-part of application No. 12/266,497, filed on Nov. 6, 2008.

(51) Int. Cl.
*E03D 9/04* (2006.01)

(52) U.S. Cl.
USPC ..... 4/213

(58) Field of Classification Search
USPC ..... 4/210–233
See application file for complete search history.

(56) References Cited

U.S. PATENT DOCUMENTS

| | | | | | |
|---|---|---|---|---|---|
| 1,331,018 | A * | 2/1920 | Luthy | 429/143 |
| 2,727,249 | A * | 12/1955 | Kochert | 4/213 |
| 3,824,637 | A * | 7/1974 | Hunnicutt, Jr. | 4/213 |
| 4,200,940 | A * | 5/1980 | Buchanan | 4/348 |
| 4,285,074 | A * | 8/1981 | Leinberry | 4/227.3 |
| 5,079,783 | A * | 1/1992 | Haletsky et al. | 4/217 |
| 5,125,119 | A * | 6/1992 | Munoz | 4/213 |
| 5,452,481 | A | 9/1995 | Meyer | |
| 5,689,837 | A * | 11/1997 | Katona | 4/214 |
| 5,819,324 | A * | 10/1998 | Bianco | 4/213 |
| D408,508 | S * | 4/1999 | Lopez | D23/311 |
| 6,233,750 | B1 * | 5/2001 | Donald et al. | 4/213 |
| 6,588,025 | B1 * | 7/2003 | Helmolt | 4/213 |
| 6,643,850 | B2 * | 11/2003 | Chasen et al. | 4/213 |
| 6,678,900 | B2 * | 1/2004 | Ware | 4/213 |
| 6,804,837 | B1 * | 10/2004 | Guess, Sr. | 4/213 |
| 6,948,192 | B2 * | 9/2005 | Hipponsteel | 4/213 |
| 7,111,330 | B1 * | 9/2006 | Korf | 4/226.1 |
| 2005/0273917 | A1 * | 12/2005 | Lapossy | 4/213 |
| 2007/0256219 | A1 * | 11/2007 | Ellinger | 4/213 |

* cited by examiner

*Primary Examiner* — Lori Baker

(57) ABSTRACT

A system for automatic flushing and odor control for a toilet having a deodorizing chamber with filtration media. Upon activation, a vacuum source provides vacuum via a vacuum tubing assembly which extracts fumes from a toilet bowl and transports them to a deodorizing chamber. The system has a manual flush assembly, and an automatic flush assembly. Upon activation of a flush handle, a flush lever moves downward, rotating a flush axis, moving a flapper lift arm upward, then lifting a flapper to initiate a flush cycle. Upon activation of an automatic flush activation switch or an automatic flush sensor, an automatic flush motor rotates a carrier gear, rotating a carrier drive rod, raising a carrier table, rotating the flush axis, moving the flapper lift arm upward, then lifting the flapper to initiate a flush cycle.

11 Claims, 8 Drawing Sheets

TOILET FLUSH AND ODOR CONTROL SYSTEM

CROSS REFERENCE

This application claims priority to U.S. non-provisional application Ser. No. 12/266,497 filed Nov. 6, 2008 as a continuation-in-part, the specification of which is incorporated herein by reference in its entirety.

BACKGROUND OF THE INVENTION

Sanitation fixtures for human waste have been used for many years. The toilet seen in widespread use today had its origins in the late nineteenth century, although significant developments were realized hundreds of years prior. Several issues have remained with this design family, however, that remain common in the usage of modern day toilets. Some of these issues include managing fumes from a user and managing germs transferred by touching the handle of the toilet. The present invention teaches an automatic flushing and odor control system for toilets that effectively addresses these concerns.

SUMMARY

The present invention features a system for automatic flushing and odor control for a toilet having a deodorizing chamber with filtration media inside located proximal to a toilet bowl. In some embodiments the system has a suction nozzle located proximal to a toilet bowl rim. In some embodiments, the system has an odor control operating system having an odor control power supply, an odor control power switch, a vacuum source, and an odor control activation switch.

In some embodiments, the system is energized for use in a standby mode upon activation of the odor control power switch. In some embodiments, upon activation of the odor control activation switch, the vacuum source is energized. In some embodiments, the vacuum source provides a source of vacuum via the suction nozzle. In some embodiments, the suction nozzle extracts fumes from the toilet bowl and transports the fumes to the deodorizing chamber. In some embodiments, the fumes are purified by the filtration media before exiting the chamber outlet aperture.

In some embodiments the system has a manual flush assembly, and an automatic flush assembly generally located in a control box. In some embodiments, the manual flush assembly has a flush lever that projects from a control box slot located through a control box side of the control box. In some embodiments, upon activation of the flush handle, a flush lever moves downward, rotating a flush axis, moving a flapper lift arm upward, then lifting a flapper to initiate a flush cycle.

In some embodiments, the automatic flush assembly is energized for use in a standby mode upon activation of an automatic flush power switch. In some embodiments, upon activation of an automatic flush activation switch or an automatic flush sensor, an automatic flush motor rotates a carrier gear, rotating the carrier drive rod, raising a carrier table, rotating the flush axis, moving the flapper lift arm upward, then lifting a flapper to initiate a flush cycle. In some embodiments, when the carrier table reaches an upper carrier positioning sensor in a second position, the automatic flush motor reverses to bring the carrier near the lower carrier positioning sensor in the first position. In some embodiments, upon reaching the first position, the system returns to the standby mode.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
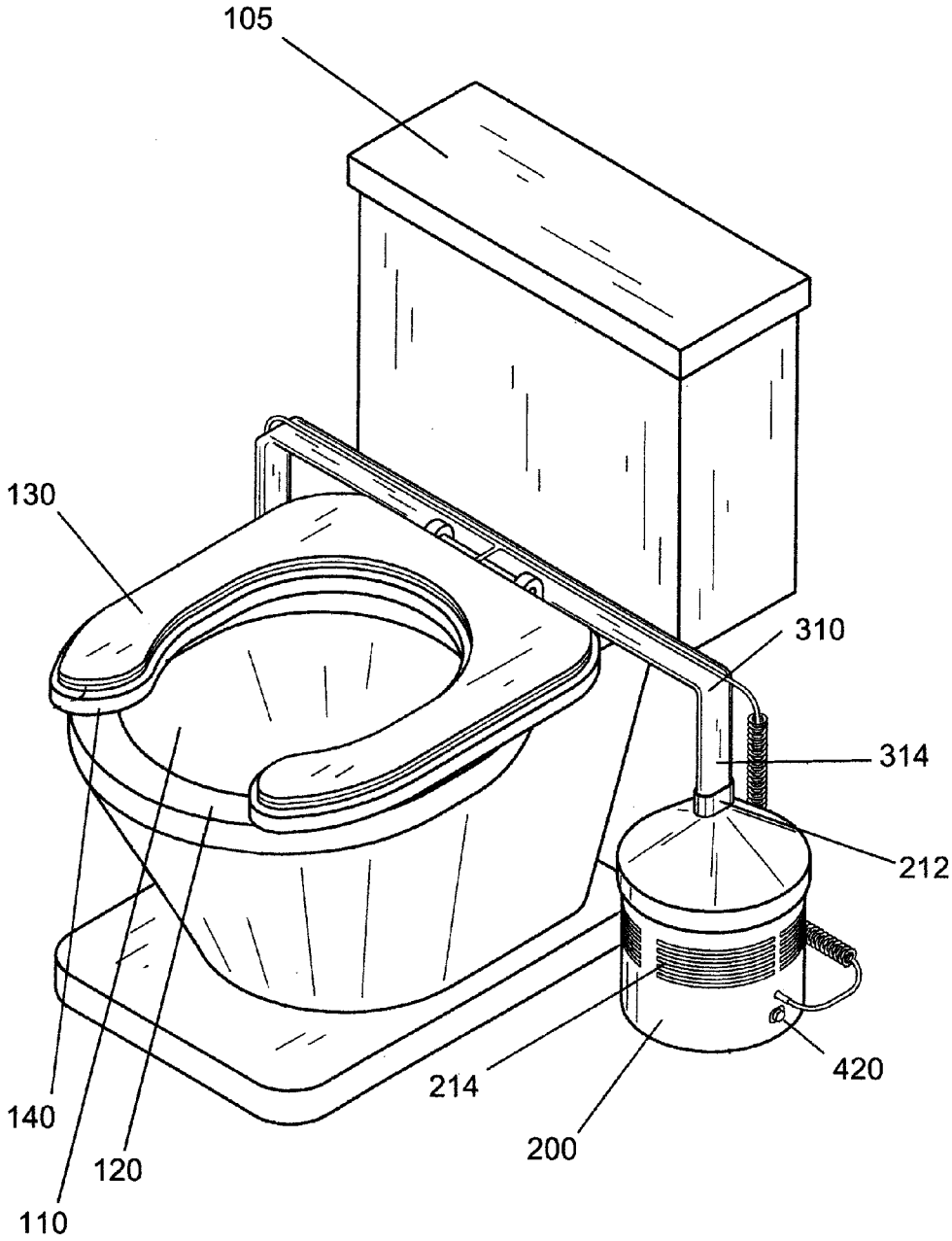
FIG. 1 is a perspective view of the present invention.

Following is a list of elements corresponding to a particular element referred to herein:

100 Toilet automatic flushing and odor control system
105 Toilet
110 Toilet bowl
120 Toilet bowl rim
130 Toilet lid
140 Toilet base lid
142 Toilet lid suction nozzle
144 Channel
146 Channel outlet
150 Toilet cover lid
152 Toilet lid cavity
154 Toilet lid cavity inlet
156 Toilet lid cavity outlet
200 Deodorizing chamber
212 Chamber inlet aperture
214 Chamber outlet aperture
220 Filtration media
222 Charcoal
300 Vacuum tubing assembly
302 Fan
304 Vacuum pump
306 Central vacuum system
308 Bellows
310 Vacuum tubing component
312 Vacuum tubing first end
314 Vacuum tubing second end
320 Suction nozzle
322 Suction nozzle first end
324 Suction nozzle second end
400 Odor control operating system
410 Odor control power supply
420 Odor control power switch
430 Vacuum source
440 Odor control activation switch
450 Odor control delay module
500 Flushing system

Figure 2:
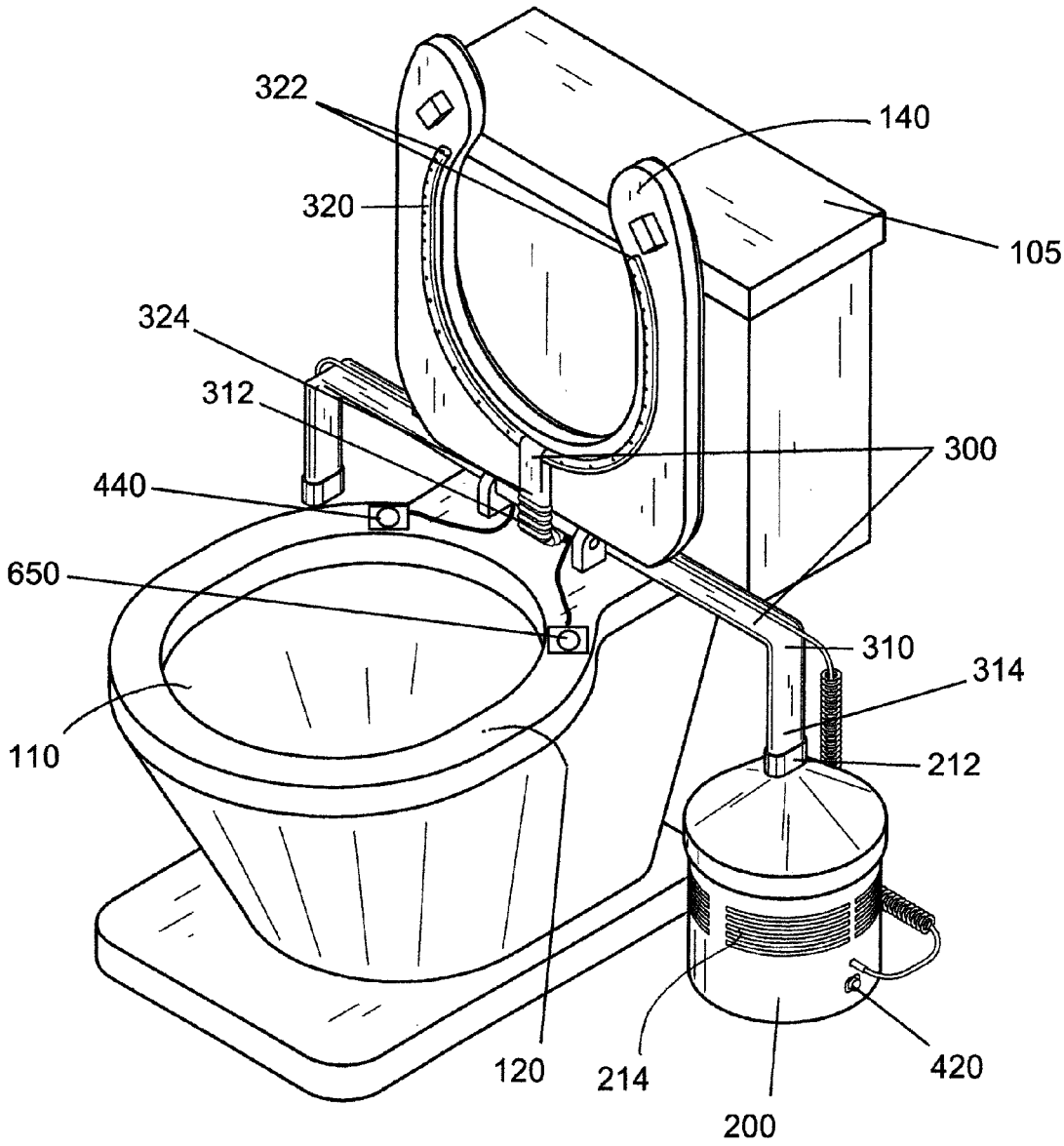
FIG. 2 is a perspective view of the present invention.
Figure 3:
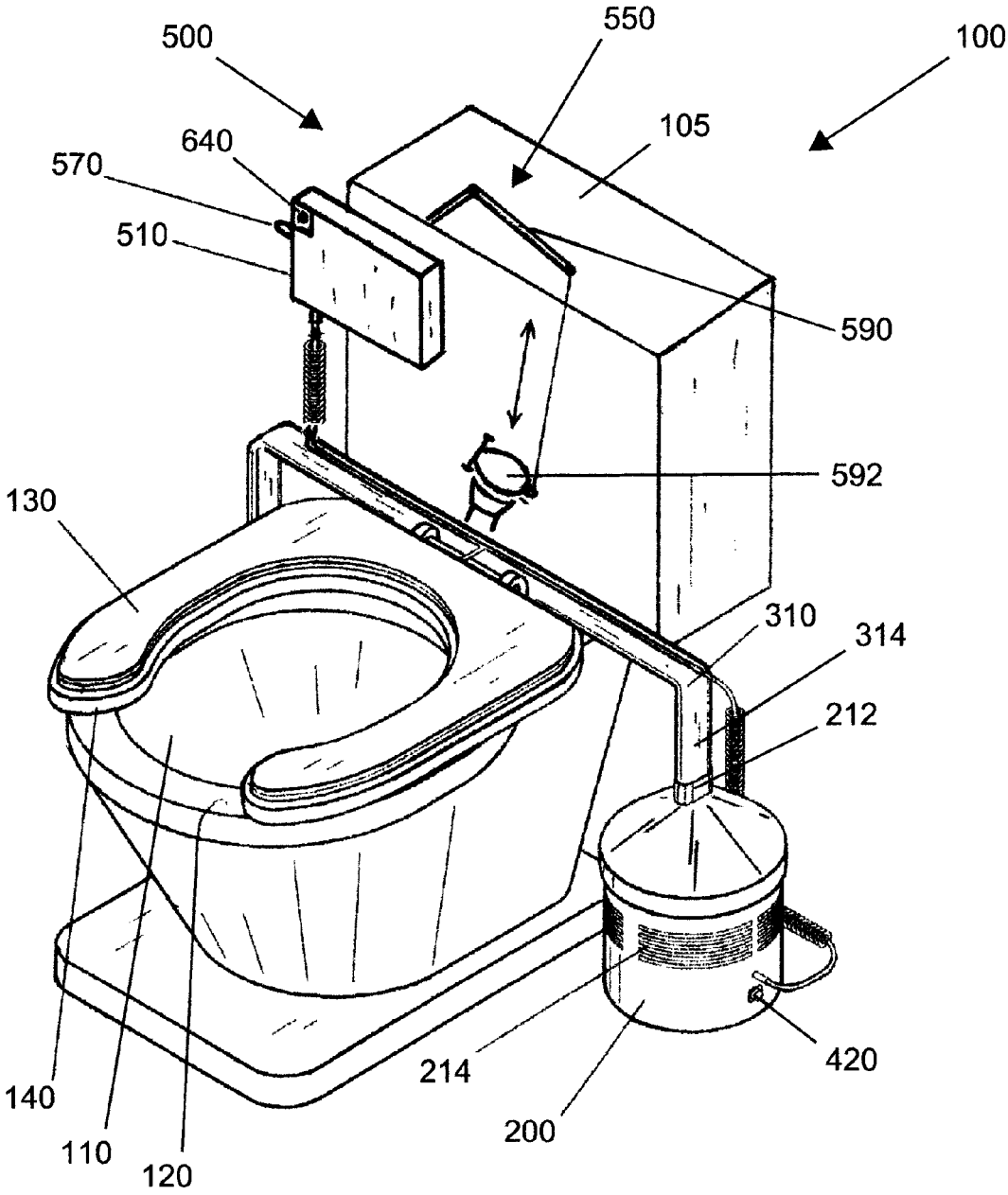
FIG. 3 is a perspective view of the manual flush assembly of the present invention.
Figure 4:
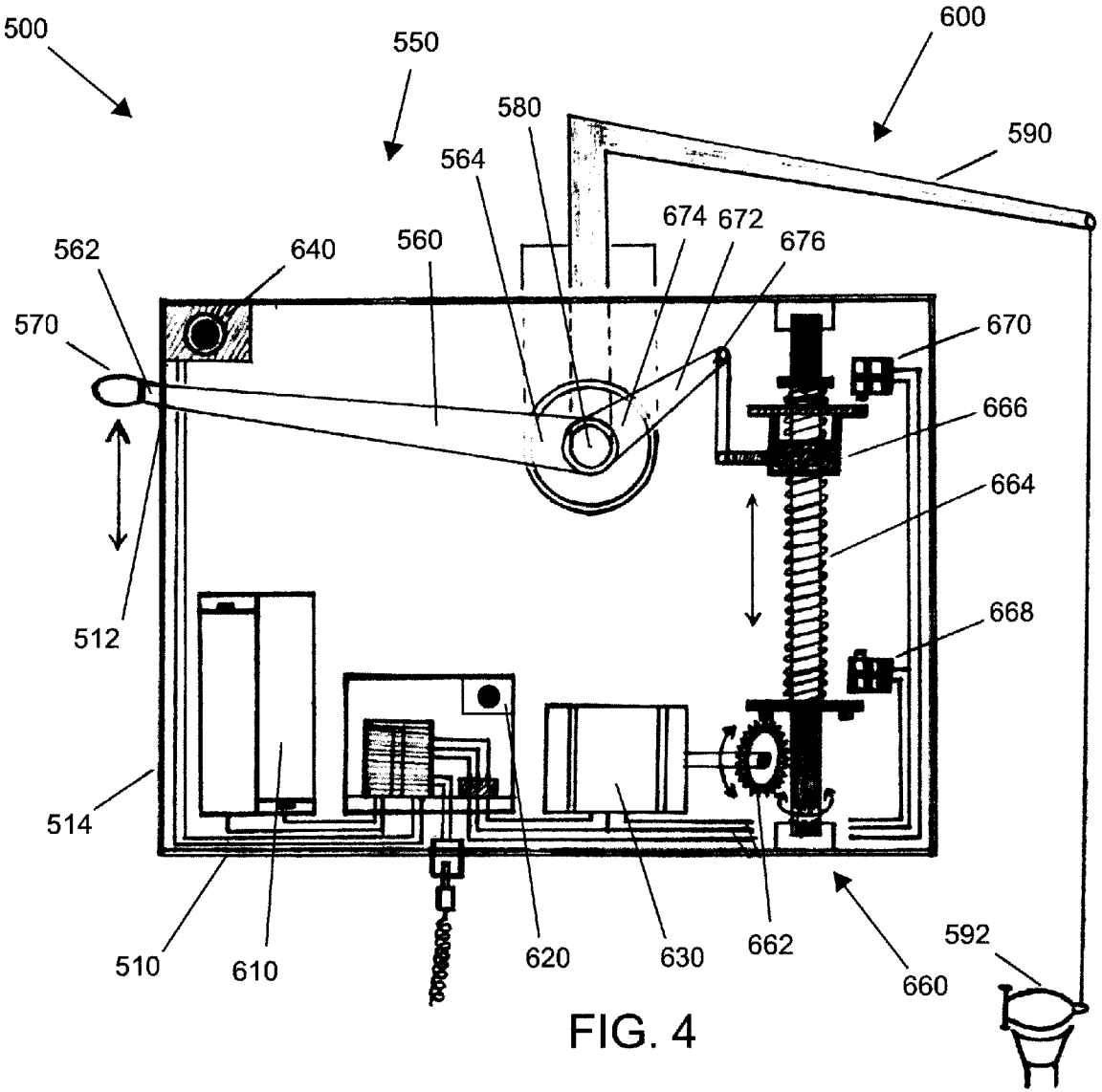
FIG. 4 is a front cross-sectional view of the automatic flush assembly of the present invention.
Figure 5:
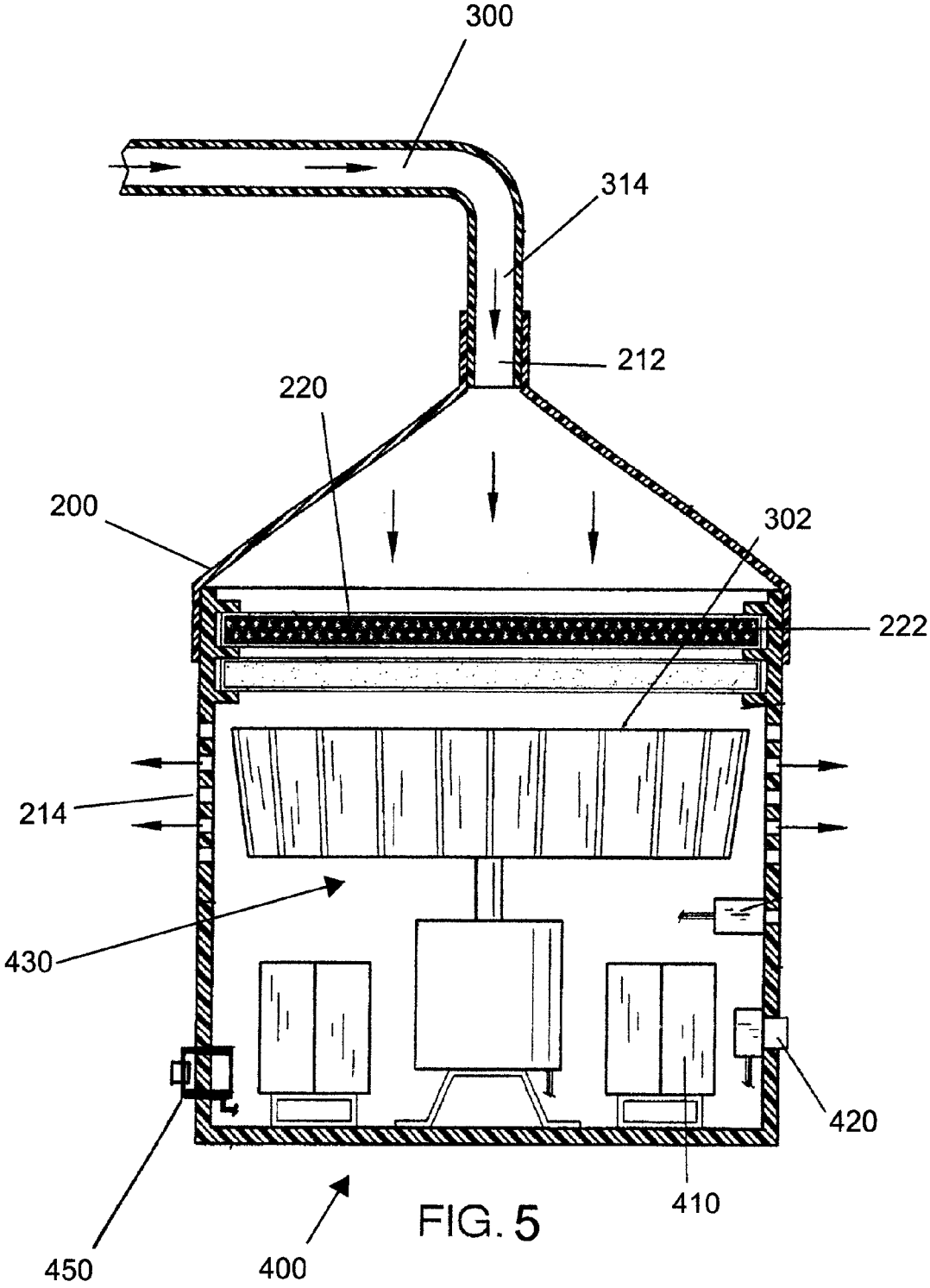
FIG. 5 is a front cross-sectional view of the deodorizing chamber of the present invention.
Figure 6:
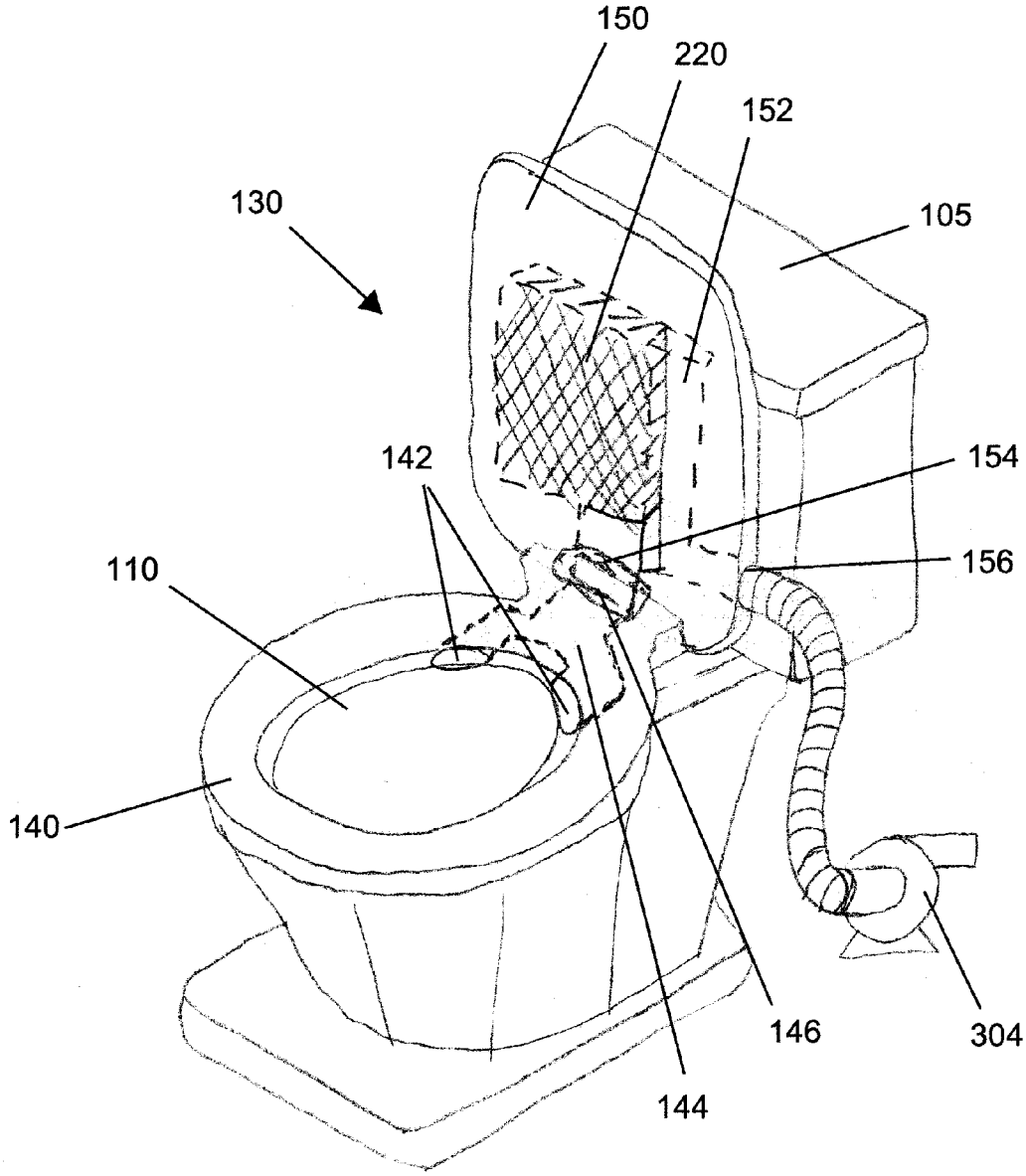
FIG. 6 is a perspective view of an alternate embodiment of the present invention.
Figure 7:
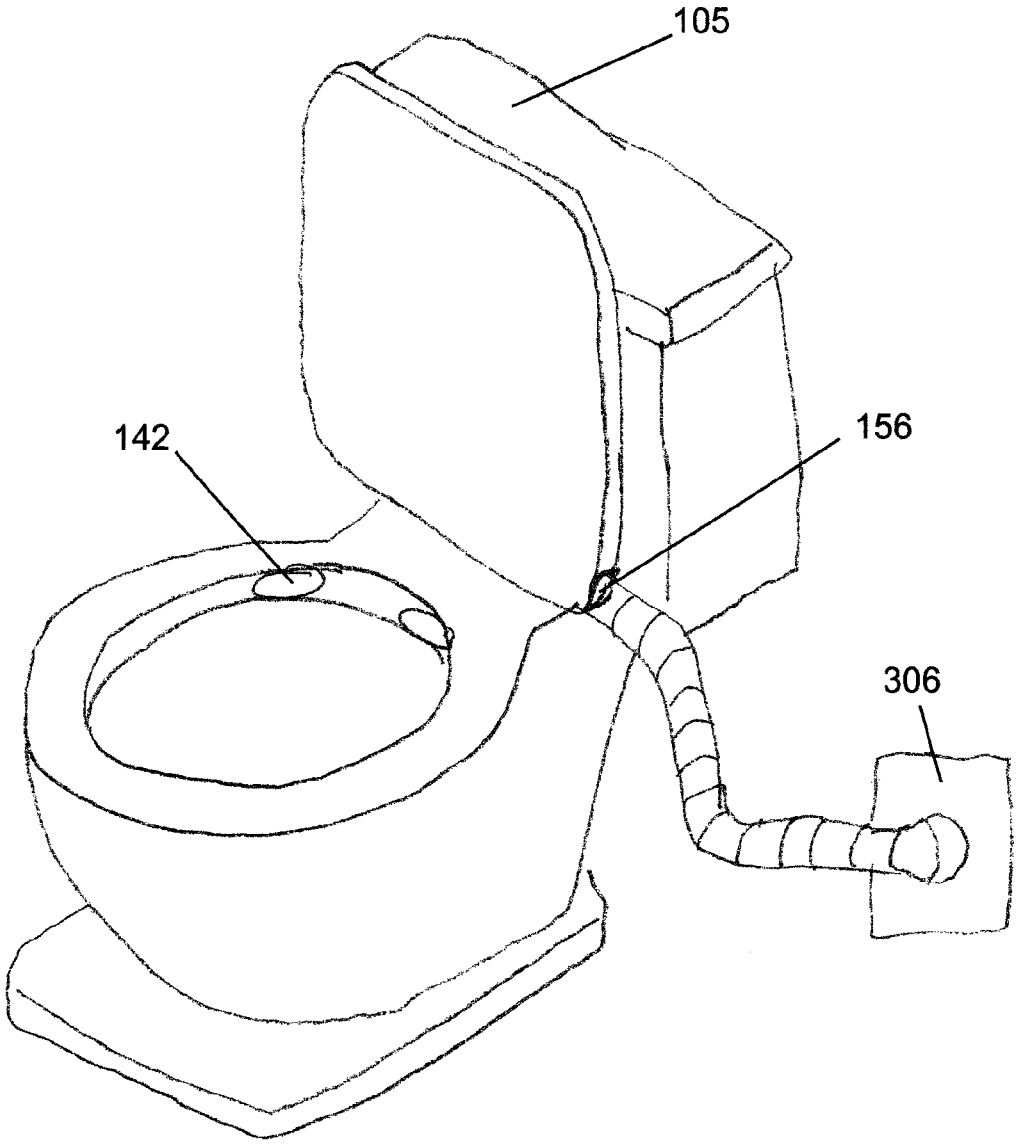
FIG. 7 is a perspective view of an alternate embodiment of the present invention.
Figure 8:
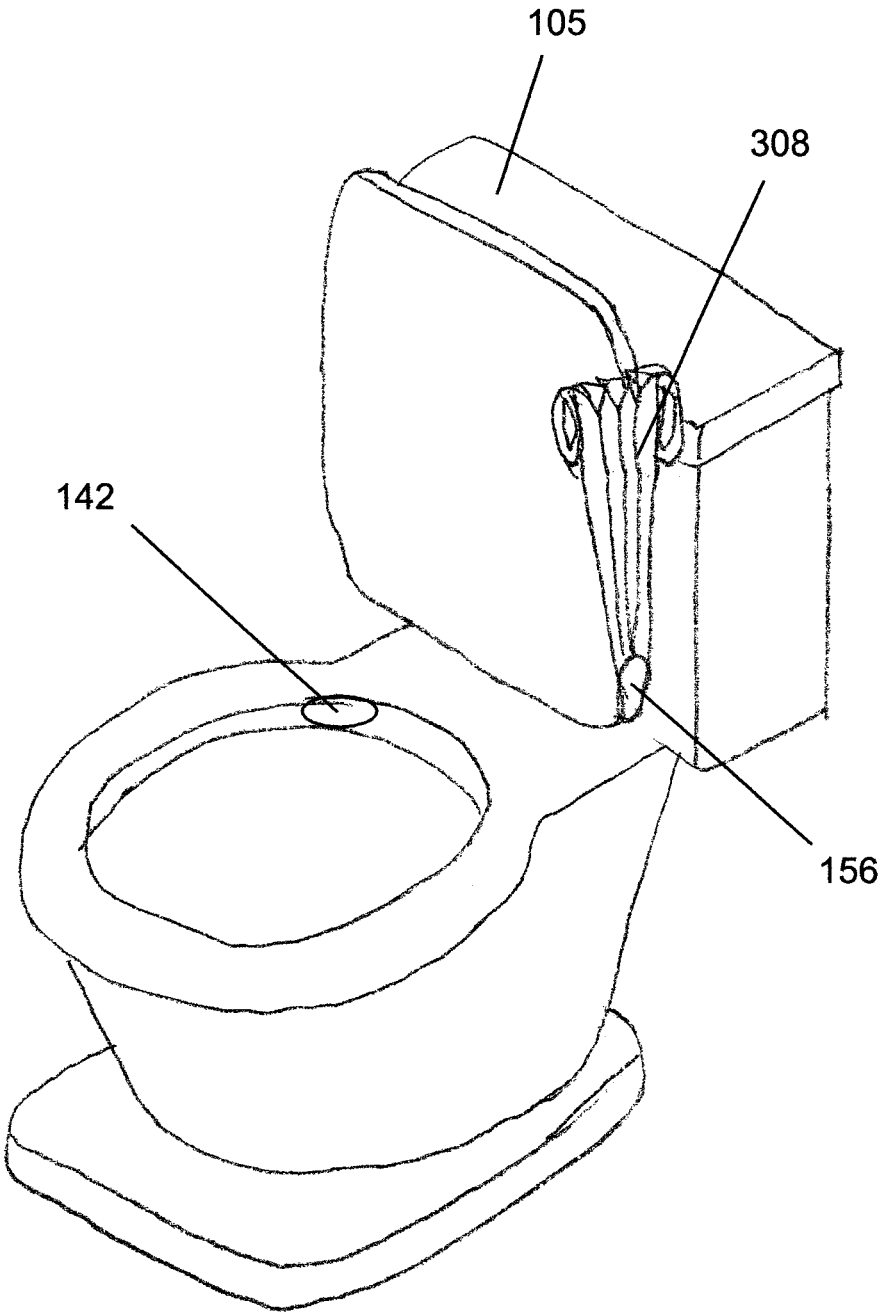
FIG. 8 is a perspective view of an alternate embodiment of the present invention.

510 Control box
512 Control box slot
514 Control box side
550 Manual flush assembly
560 Flush lever
562 Flush lever first end
564 Flush lever second end
570 Flush handle
580 Flush axis
590 Flapper lift arm
592 Flapper
600 Automatic flush assembly
610 Automatic flush power supply
620 Automatic flush power switch
630 Automatic flush motor
640 Automatic flush activation switch
650 Automatic flush sensor
660 Automatic flush carrier assembly
662 Carrier gear
664 Carrier drive rod
666 Carrier table
668 Lower carrier positioning sensor
670 Upper carrier positioning sensor
672 Carrier lever
674 Carrier lever first end
676 Carrier lever second end Referring now to FIGS. 1-8, the present invention features a system (100) for automatic flushing and odor control for a toilet (105). In some embodiments, the system (100) comprises a deodorizing chamber (200) located proximal to a toilet bowl (110). In some embodiments, the deodorizing chamber (200) comprises a chamber inlet aperture (212) located on and fluidly connected to the deodorizing chamber (200). In some embodiments, a chamber outlet aperture (214) is located on and fluidly connected to the deodorizing chamber (200). In some embodiments, filtration media (220) is located in the deodorizing chamber (200).

In some embodiments the system (100) comprises a vacuum tubing assembly (300). In some embodiments, the vacuum tubing assembly (300) comprises a vacuum tubing component (310), having a vacuum tubing first end (312), and a vacuum tubing second end (314). In some embodiments, the vacuum tubing second end (314) is located on and fluidly connected to the chamber inlet aperture (212). In some embodiments, the vacuum tubing assembly (300) comprises a suction nozzle (320), having a suction nozzle first end (322), located proximal to a toilet bowl rim (120), and a suction nozzle second end (324) located on and fluidly connected to the vacuum tubing first end (312).

In some embodiments, the system (100) comprises an odor control operating system (400). In some embodiments, the odor control operating system (400) comprises an odor control power supply (410) operatively connected to an odor control power switch (420). In some embodiments, the odor control power switch (420) is operatively connected to a vacuum source (430). In some embodiments, an odor control activation switch (440) is located on a toilet lid (130) and operatively connected to the vacuum source (430).

In some embodiments, the system (400) is energized for use in a standby mode upon activation of the odor control power switch (420). In some embodiments, upon activation of the odor control activation switch (440), the vacuum source (430) is energized to provide a source of vacuum via the vacuum tubing assembly (300). In some embodiments, the suction nozzle (320) extracts fumes from the toilet bowl (110) and transports the fumes to the deodorizing chamber (200) via the vacuum tubing assembly (300). In some embodiments, the fumes are purified by the filtration media (220). In some embodiments, clean air exits the chamber outlet aperture (214).

In some embodiments, the system (100) comprises a flushing system (500). In some embodiments, the flushing system (500) comprises a manual flush assembly (550), and an automatic flush assembly (600) generally located in a control box (510). In some embodiments, the manual flush assembly (550) comprises a flush lever (560) that projects from a control box slot (512) located through a control box side (514). In some embodiments, a flush handle (570) is located on a flush lever first end (562). In some embodiments, a flush lever second end (564) is perpendicularly located on a flush axis (580) that rotates and is located in the control box (510). In some embodiments, a flapper lift arm (590) is perpendicularly located on the flush axis (580). In some embodiments, upon activation of the flush handle (570), the flush lever (560) moves downward, thereby rotating the flush axis (580), moving the flapper lift arm (590) upward, and lifting the flapper (592) via a cord to initiate a flush cycle.

In some embodiments, the system comprises an automatic flush assembly (600). In some embodiments, the automatic flush assembly (600) comprises an automatic flush power supply (610) located in the control box (510). In some embodiments, the automatic flush assembly (600) comprises an automatic flush power switch (620) operatively connected to an automatic flush motor (630) located in the control box (510). In some embodiments, the automatic flush assembly (600) comprises an automatic flush activation switch (640) located on the control box (510). In some embodiments, the automatic flush activation switch (640) is operatively connected to the automatic flush motor (630). In some embodiments, the automatic flush assembly (600) comprises an automatic flush sensor (650) located on a toilet lid (130) and operatively attached to the automatic flush motor (630).

In some embodiments, the automatic flush assembly (600) comprises an automatic flush carrier assembly (660) located in the control box (510). In some embodiments, the automatic flush carrier assembly (660) comprises a carrier gear (662) located on the automatic flush motor (630) that engages and interfaces with a carrier drive rod (664). In some embodiments, the automatic flush carrier assembly (660) comprises a carrier table (666) located between a lower carrier positioning sensor (668) and an upper carrier positioning sensor (670) on the carrier drive rod (664). In some embodiments, the automatic flush carrier assembly (660) comprises a carrier lever (672) having a carrier lever first end (674) perpendicularly located on the flush axis (580) and a carrier lever second end (676) attached to the carrier table (666).

In some embodiments, the system (500) is energized for use in a standby mode upon activation of the automatic flush power switch (620). In some embodiments, the carrier table is located proximal to the lower carrier positioning sensor (668) in a first position. In some embodiments, upon activation of the automatic flush activation switch (640) or the automatic flush sensor (650), the automatic flush motor (630) rotates the carrier gear (662), rotating the carrier drive rod (664), raising the carrier table (666), rotating the flush axis (580), moving the flapper lift arm (590) to initiate a flush cycle. In some embodiments, when the carrier table (666) reaches the upper carrier positioning sensor (670) in a second position, the automatic flush motor (630) reverses to return the carrier table (666) proximal to the lower carrier positioning sensor (668) in the first position. In some embodiments, once the carrier table (666) reaches the first position, the system returns to the standby mode.

In some embodiments, the filtration media (220) is charcoal (222). In some embodiments, the filtration media (220) is removable. In some embodiments, the filtration media (220) is a cartridge.

In some embodiments, the vacuum source (430) is a fan (302) or a blower. In some embodiments, the vacuum source (430) is a vacuum pump (304). In some embodiments, the vacuum source (430) is a household central vacuum system (306). In some embodiments, the vacuum source (430) is a mechanical bellows (308).

In some embodiments, the system (100) comprises a toilet lid (130) having a generally annular toilet base lid (140) and a planar toilet cover lid (150). In some embodiments, the annular toilet base lid (140) comprises an integral toilet lid suction nozzle (142) located proximal to the toilet bowl rim (120). In some embodiments, the annular toilet base lid (140) comprises a plurality of integral toilet lid suction nozzles (142) located proximal to the toilet bowl rim (120). In some embodiments, a channel (144) fluidly passes through the cross section of the toilet base lid (140) connecting the toilet lid suction nozzle (142) to a channel outlet (146). In some embodiments, the planar toilet cover lid (150) comprises a toilet lid cavity (152) having filtration media (220) located therein. In some embodiments, a toilet lid cavity inlet (154) is fluidly connected to the channel outlet (146). In some embodiments, a vacuum source (430) is attached to a toilet lid cavity outlet (156) located on the toilet cover lid (150).

In some embodiments, an odor control delay module (450) is operatively connected to the vacuum source (430). In some embodiments, upon activation of the odor control activation switch (440), the odor control delay module (450) provides a specified delay before the vacuum source (430) is deenergized.

In some embodiments, the automatic flush power supply (610) is alternating current electricity. In some embodiments, the odor control power supply (410) is alternating current electricity.

As used herein, the term "about" refers to plus or minus 10% of the referenced number. For example, an embodiment wherein a device is about 10 inches in length includes a device that is between 9 and 11 inches in length.

The disclosures of the following U.S. Patents are incorporated in their entirety by reference herein: U.S. Pat. Pub. No. 2007/0256219; U.S. Pat. Pub. No. 2005/0273917; U.S. Pat. No. 6,948,192; U.S. Pat. No. 6,678,900; U.S. Pat. No. 6,643,850; U.S. Pat. No. 6,588,025; U.S. Pat. No. 6,233,750; U.S. Pat. No. 5,819,324; U.S. Pat. No. 5,452,481; U.S. Pat. No. 5,079,783; U.S. Pat. No. 4,200,940; U.S. Pat. No. 3,824,637; U.S. Pat. No. 2,727,249.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A system (100) for automatic flushing and odor control for a toilet (105), the system (100) comprising:

(A) a deodorizing chamber (200) disposed proximal to a toilet bowl (110), wherein the deodorizing chamber (200) comprises:

(i) a chamber inlet aperture (212) disposed thereon and fluidly connected to the deodorizing chamber (200), and a chamber outlet aperture (214) disposed thereon and fluidly connected to the deodorizing chamber (200), and (ii) filtration media (220) disposed therein;

(B) a vacuum tubing assembly (300) comprising:

(i) a vacuum tubing component (310), having a vacuum tubing first end (312), and a vacuum tubing second end (314), wherein the vacuum tubing second end (314) is disposed on and fluidly connected to the chamber inlet aperture (212), and (ii) a suction nozzle (320), having a suction nozzle first end (322), disposed proximal to a toilet bowl rim (120), and a suction nozzle second end (324) disposed on and fluidly connected to the vacuum tubing first end (312);

(C) an odor control operating system (400) comprising:

a odor control power supply (410) operatively connected to an odor control power switch (420), wherein the odor control power switch (420) is operatively connected to a vacuum source (430), wherein an odor control activation switch (440) is disposed on a toilet lid (130) and operatively connected to the vacuum source (430), wherein the system (400) is energized for use in a standby mode upon activation of the odor control power switch (420), wherein upon activation of the odor control activation switch (440), the vacuum source (430) is energized to provide a source of vacuum via the vacuum tubing assembly (300), wherein the suction nozzle (320) extracts fumes from the toilet bowl (110) and transports the fumes to the deodorizing chamber (200) via the vacuum tubing assembly (300), wherein the fumes are purified by the filtration media (220), wherein clean air exits the chamber outlet aperture (214); and (D) a flushing system (500) comprising a manual flush assembly (550), and an automatic flush assembly (600) generally disposed in a control box (510), wherein the manual flush assembly (550) comprises a flush lever (560) that projects from a control box slot (512) disposed through a control box side (514), wherein a flush handle (570) is disposed on a flush lever first end (562), wherein a flush lever second end (564) is perpendicularly disposed on an flush axis (580) rotatingly disposed in the control box (510), wherein a flapper lift arm (590) is perpendicularly disposed on the flush axis (580), wherein upon activation of the flush handle (570), the flush lever (560) moves downward, thereby rotating the flush axis (580), moving the flapper lift arm (590) upward, and lifting the flapper (592) via a cord to initiate a flush cycle, wherein the automatic flush assembly (600) comprises:

(i) an automatic flush power supply (610) disposed in the control box (510), (ii) an automatic flush power switch (620) operatively connected to a automatic flush motor (630) disposed in the control box (510), (iii) an automatic flush activation switch (640) disposed on the control box (510) operatively connected to the automatic flush motor (630), (iv) an automatic flush sensor (650) disposed on a toilet lid (130) and operatively attached to the automatic flush motor (630), (v) an automatic flush carrier assembly (660) disposed in the control box (510) comprising a carrier gear (662) disposed on the automatic flush motor (630) that engagably interfaces with a carrier drive rod (664), a carrier table (666) disposed between a lower carrier positioning sensor (668) and an upper carrier positioning sensor (670) on the carrier drive rod (664), and a carrier lever (672) having a carrier lever first end (674) perpendicularly disposed on the flush axis (580) and a carrier lever second end (676) disposed on the carrier table (666), wherein the system (500) is energized for use in a standby mode upon activation of the automatic flush power switch (620), wherein the carrier table is disposed proximal to the lower carrier positioning sensor (668) in a first position, wherein upon activation of the automatic flush activation switch (640) or the automatic flush sensor (650), the automatic flush motor (630) rotates the carrier gear (662), rotating the carrier drive rod (664), raising the carrier table (666), rotating the flush axis (580), moving the flapper lift arm (590) to initiate a flush cycle, wherein when the carrier table (666) upon reaching the upper carrier positioning sensor (670) in a second position, the automatic flush motor (630) reverses to return the carrier table (666) proximal to the lower carrier positioning sensor (668) in the first position, wherein the system returns to the standby mode.

2. The system (100) of claim 1, wherein the filtration media (220) is charcoal (222).

3. The system (100) of claim 1, wherein the vacuum source (430) is a fan (302) or a blower.

4. The system (100) of claim 1, wherein the vacuum source (430) is a vacuum pump (304).

5. The system (100) of claim 1, wherein the vacuum source (430) is a household central vacuum system (306).

6. The system (100) of claim 1, wherein the vacuum source (430) is a mechanical bellows (308).

7. The system (100) of claim 1, wherein the system (100) comprises a toilet lid (130) having a generally annular toilet base lid (140) and a planar toilet cover lid (150);

wherein the annular toilet base lid (140) comprises an integral toilet lid suction nozzle (142) disposed proximal to the toilet bowl rim (120), wherein a channel (144) fluidly passes through the cross section of the toilet base lid (140) connecting the toilet lid suction nozzle (142) to a channel outlet (146), wherein the planar toilet cover lid (150) comprises a toilet lid cavity (152) having filtration media (220) disposed therein, wherein a toilet lid cavity inlet (154) is fluidly connected to the channel outlet (146), wherein a vacuum source (430) is attached to a toilet lid cavity outlet (156) disposed on the toilet cover lid (150).

8. The system (100) of claim 7, wherein the filtration media (220) is removable.

9. The system (100) of claim 1, wherein an odor control delay module (450) is operatively connected to the vacuum source (430), wherein upon activation of the odor control activation switch (440), the odor control delay module (450) provides a specified delay before the vacuum source (430) is deenergized.

10. The system (100) of claim 1, wherein the automatic flush power supply (610) is alternating current electricity.

11. The system (100) of claim 1, wherein the odor control power supply (410) is alternating current electricity.

* * * * *